US005209685A

United States Patent [19]

Hammes

[11] Patent Number: 5,209,685

[45] Date of Patent: May 11, 1993

[54] ICE LIFESAVING DEVICE

[76] Inventor: Robert B. Hammes, 2910 Knollcrest Dr., Burlington, Wis. 53105

[21] Appl. No.: 853,143

[22] Filed: Mar. 18, 1992

[51] Int. Cl.[5] ..... B63C 9/32

[52] U.S. Cl. ..... 441/82; 30/164.7; 294/26; 294/61

[58] Field of Search ..... 294/15, 25, 26, 50, 294/50.5, 61, 126; 16/110 R, 111 R, 116 R; 30/151, 162, 164.5, 164.7, 340; 43/5, 6; 441/80, 82, 136

[56] References Cited

U.S. PATENT DOCUMENTS

| | | | |
|---|---|---|---|
| 717,998 | 1/1903 | Huebner | 30/164.5 X |
| 1,181,681 | 5/1916 | Nicaud | 30/162 |
| 1,424,221 | 8/1922 | Trumpeter | 30/164.5 |
| 1,571,890 | 2/1926 | Schaum | 30/164.5 |
| 2,725,253 | 11/1955 | Wallman | 294/26 |
| 3,130,884 | 4/1964 | Lintz | 30/164.5 |
| 3,752,524 | 8/1973 | Reick, Jr. | 294/25 |
| 3,848,689 | 11/1974 | Hilterhaus | 294/26 X |
| 3,861,731 | 1/1975 | Young | 294/26 X |
| 4,002,366 | 1/1977 | Hammes | 294/26 |
| 4,020,551 | 5/1977 | Lindqvist | 294/26 X |
| 4,502,722 | 3/1985 | Rocquin | 294/61 |
| 4,815,997 | 3/1989 | Forsmark et al. | 441/82 |

*Primary Examiner*—Johnny D. Cherry
*Attorney, Agent, or Firm*—Richard Litman

[57] ABSTRACT

An accessory serving as an aid for saving the life of an "ice" fisherman, snow mobile operator, or other recreation or sports minded person who ventures onto an ice covered lake, pond or other body of water and breaks through the ice. The accessory includes two ice picks connected together by a floatable cord. Each ice pick includes a casing forming a handle having elongated external recesses helpful for hand gripping, and a pair of notches or grooves to facilitate gripping by the thumb and index finger. Each casing has an internal bore configured to receive an ice pick, a spring biased sheath, and a molded floatation plug, enabling the accessory to float when dropped into a body of water. The floatation plug may be formed of a closed cell, foamed plastic. The floatation plug has circumferentially spaced slots which engage fins connecting a central pick holder to an inner surface of a bore within the handle.

8 Claims, 1 Drawing Sheet

ICE LIFESAVING DEVICE

RELATED APPLICATION

This application is an improvement of my earlier application Ser. No. 06/636,218 filed Nov. 28, 1975, now U.S. Pat. No. 4,002,366 issued Jan. 11, 1977.

BACKGROUND OF THE INVENTION

1. Field Of The Invention

This invention relates to an improvement of the life saving aid disclosed and claimed in my prior U.S. Pat. No. 4,002,366 which issued Jan. 11, 1977, and incorporated herein by reference.

In my earlier patent I disclosed a pair of ice piercing picks each embedded in a handle which also included a spring biased sheath designed to cover the sharp end of the pick when not engaged in ice. Each handle had an internal cavity or bore for receiving a spring surrounding the pick, and an enlarged head of said sheath. The handles were connected by a cord to enable easy retrieval in the event a user fell through ice covering a body of water. The picks enable a user to pull himself or herself out of a hole in the ice.

It was discovered during use that without a finger grip, the downward thrust of the pick upon hitting the ice causes the pick handle to slip from the user'hand. It was also discovered that a user could easily lose the picks after a period of time, in that, while designed to float, after a while the picks and the interconnecting cords apparently become overloaded with water and begin to sink.

In my improvement, the pick handles are provided with an indent or groove in the upper portion thereof to improve the user's grip. Also provided is an insert molded from a buoyancy enhancing material such as a closed cell expanded or foamed material. The molded insert fits inside the handle as a liner for the internal cavity or bore, so as to provide added buoyancy to the handle. Similarly, the cord connecting the two picks incorporates internally a buoyant material so that the cord will float in water.

DESCRIPTION OF THE RELATED PRIOR ART

U.S. Pat. No. 1,181,681 issued May 2, 1916 to Edouard-Pierre Nicaud is directed to a dagger having a retractable protective sheath covering the dagger's edge when not in use.

U.S. Pat. No. 1,424,221 issued Aug. 1, 1922 to George Trumpeter is directed to an ice pick having a retractable sheath for protecting a pointed edge of the ice pick when not in use.

U.S. Pat. No. 3,130,884 issued Apr. 28, 1964 to James T. Lintz is directed to an automobile escape tool, more specifically to a tool for breaking glass windows use by individuals trapped in a car submerged under water.

U.S. Pat. No. 3,752,524 issued Aug. 14, 1973 to Otto Reick, Jr. is directed to an ice gripping device having retractable prongs, the ice gripping device being designed to be worn on the user's clothing.

U.S. Pat. No. 4,815,997 issued Mar. 28, 1989 to Martin Forsmark and Per Wedlin is directed to a set of ice prods comprising two prods connected by a cord, each prod including a handle having an internal cavity which is partially filled with a buoyancy enhancing material such as a closed cell expanded material.

SUMMARY AND OBJECTS OF THE INVENTION

None of the above identified patents include all of the elements of my improved device. The handles of my improved device are provided with a groove or recess near the top thereof whereby the handles may be gripped more firmly than before. The cord connecting two of the handles together has buoyant material added thereto to enable the cord to float on the water in the event the handles get away from the user. Additionally, a molded, buoyant insert is provided in the handles in the form of a liner designed to receive the ice pick and a spring in a central bore thereof, said insert adding to the buoyancy of the handles. The insert includes slots circumferentially spaced, preferably 90 degrees apart, at the top thereof, configured to receive fins formed on an upper cylindrical portion of a pick holder. Below the cylindrical portion the pick holder tapers toward the pick in the form of a truncated cone, forming an upper stop for the spring. Narrow ribs extend from the fins along the surface of an inner bore to form an upper stop engaging the top surface of the head portion of a sheath covering the pointed end of the pick. The top surface of the sheath head portion bears against the lower end of the spring. The sheath has an axially aligned bore to receive the pick, the sheath being held against spring bias within the handle bore by a bushing which closes the bottom end of the handle bore.

Accordingly, it is an object of this invention to provide an improved pick arrangement for saving the lives of individuals who have fallen through the ice covering a body of water.

It is a further object of this invention to provide enhanced gripping means for a pair of ice picks.

It is another object of this invention to provide floatation means for a pair of ice picks and their connecting cord.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description and not limitation.

Figure 3:
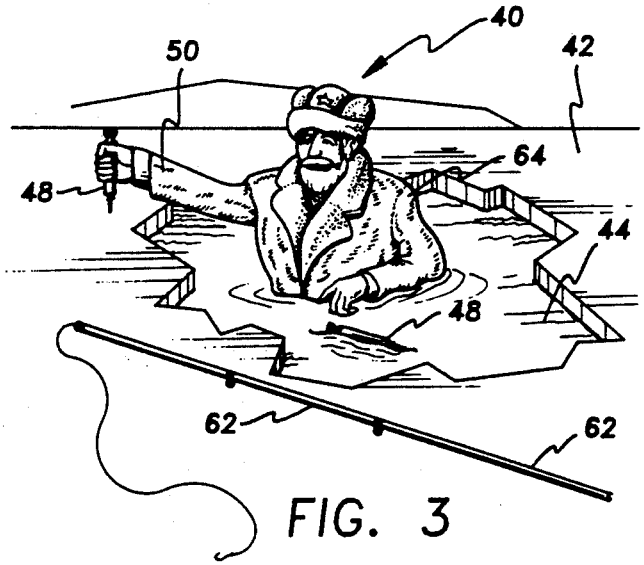
FIG. 3 is an environmental view showing a pair of ice picks connected with a floatable cord in use as a lifesaving device.

Referring to FIG. 3, I have shown pictorially a person 40 who has broken through the ice 42 covering a body of water 44 and is now faced with the task of extracting himself from opening 46 in the ice covering by applying ice piercing pick device 48, thus gradually pulling himself away from the opening 46 a few more inches with each ice piercing stroke of a pick device 48 and then manually pulling himself toward the temporarily anchored pick device 48. In a prone position, shown in FIG. 1 of my above identified prior U.S. Pat. No. 4,002,366, the weight of a person 40 upon the ice covering adjacent the opening 46 is distributed over a much larger surface area of such ice covering and hence the ice covering is capable of supporting the person pending further rescue, if necessary.

It will be understood that the person 40 was standing upright on the ice 42 with a fishing rod 62—a concentrated weight load on such ice covering—causing the ice 42 to break and the person 40 to sink into the water 44 at the opening 46. One of his hands can be employed to engage the ice 42 adjacent to opening 46, preventing total submergence, while the other hand is available to remove the ice piercing pick devices 48 from his jacket 64.

In FIG. 3, two ice piercing pick devices 48 are shown to be tied together by means of an interconnecting rope or cord 50 which incorporates or is formed of any suitable material capable of floating on the water 44. The ice piercing pick devices 48 also include a molded floatation plug 56 further described below to enable ice piercing pick devices 48 to also float, thereby to avoid accidently losing the ice piercing devices 48 in a panic situation. When interconnecting rope or cord 50 is used, it is possible for such assemblage to be tossed as a unit by one person to another person who has broken through the ice 42 and has no ice piercing pick devices 48 on him. It is also possible to quickly remove the assemblage "unitarily" by grasping any portion thereof, for example, the rope or cord 50 only, one ice piercing device 48 only, etc., and giving a "pull". It is preferable that the cord or rope 50 be made of bright colored materials, such as brilliant orange, for rapid visual notice when needed. It will be understood that if the cord or rope 50 is eliminated, two of the ice piercing devices 48 may be inserted into a jacket pocket and then be removed by a free hand and subsequently grasped by both hands, one in each hand.

Figure 1:
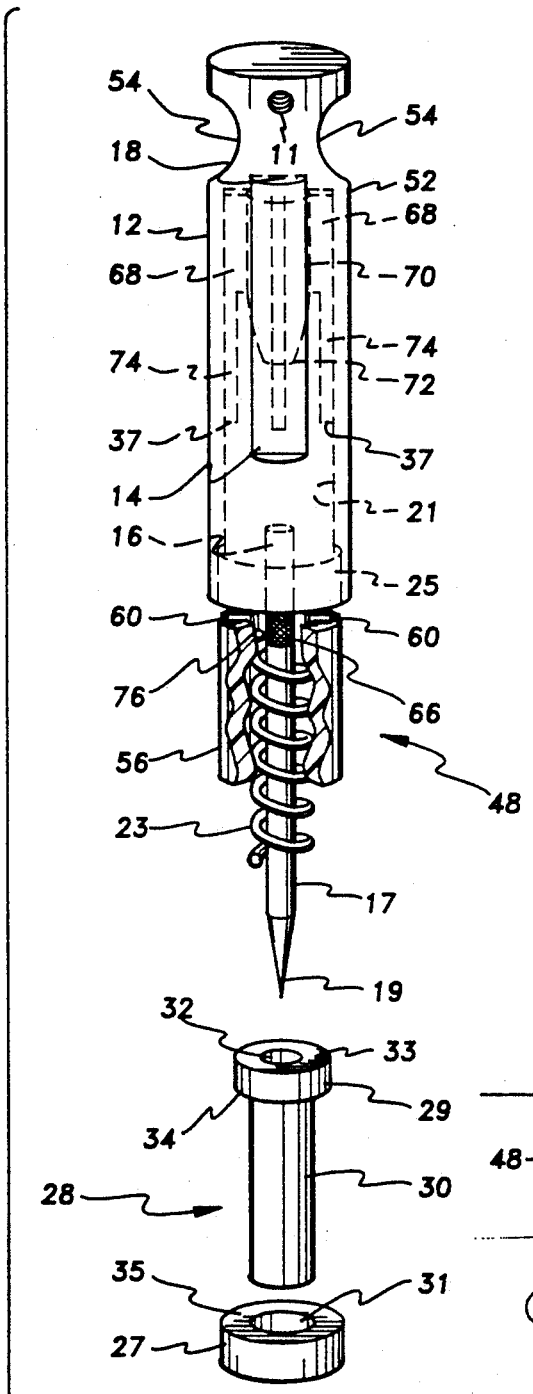
FIG. 1 is an exploded view showing the several elements of the ice pick.
Figure 2:
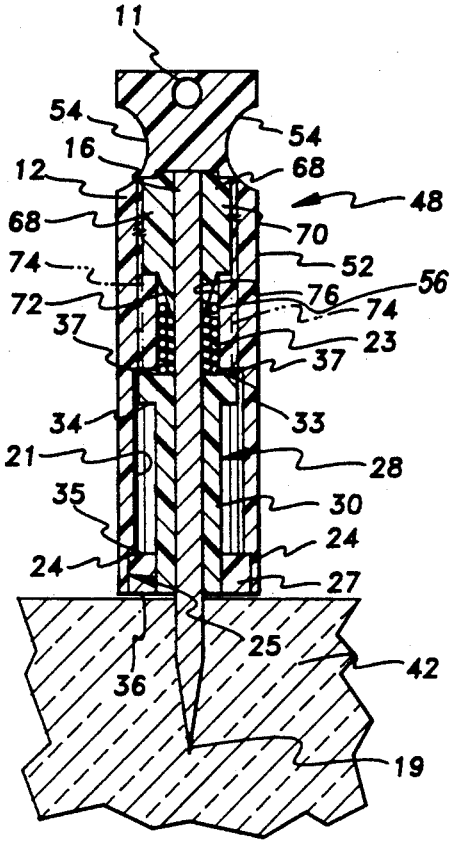
FIG. 2 is a cross sectional view of the ice pick with the sheath pushed into a retracted position.

In FIGS. 1 and 2, I have shown how cord or rope 50 can be fastened to the upper end of each ice piercing pick device 48 by feeding one end (while unknotted) through a passage 11 extending through an outer casing 12 at its upper end. Then knots can be formed for retaining each ice piercing pick device 48 at opposite ends of the cord or rope 50.

The structural components of a preferred ice piercing pick device 48 are shown in FIG. 1. In FIG. 1, outer casing 12 forms a hand gripping handle 52 having a pair of grooves or recesses 54 near the top thereof to provide a thumb and index finger grip area to enable a user to retain his or her grip on the handle 52 when thrusting the ice piercing pick device 48 downward and hitting the ice 42.

Outer casing 12 is provided with a pair of elongated recessed areas 14 (only one shown) which are helpful for hand gripping of the exterior of the outer casing 12.

Outer casing 12 is preferably formed of a synthetic resin material as an injection molded component, or may be fabricated of other material if desired. The blunt or upper end 16 of the pick 17 may be embedded in the upper portion 18 of the casing 12 at the time of the injection molding process, or it can be forcibly pressed into an elongated axial passage previously formed in the casing 12. In either event a substantial portion of the upper end 16 of the pick 17 is provided with a heavy knurled outer surface 66 as shown in FIGS. 3 and 4 of my above identified earlier U.S. Pat. No. 4,002,366 so that pick 17 is firmly anchored to the casing 12. Pick 17 may be formed of steel or other suitable rigid and strong material so that the pointed end does not bend or otherwise become damaged when jabbed repeatedly into the ice 42. The upper portion 18 of casing 12 is formed as an axially aligned cylinder 70 having circumferentially spaced, longitudinally extending fins 68 which connect with the inner surface of cylindrical bore 21 provided internally of casing 12. The lower end of cylinder 70 tapers toward pick 17 in the form of a frusto conical configuration 72, which provides an upper limit stop for compression spring 23 surrounding pick 17. Also at the lower end of cylinder 70, fins 68 are reconfigured as narrow elongated ribs 74 formed on the inner surface of bore 21. The ends of ribs 74 provide a stop shoulder 37 for protective pick guard 28 described below. Counter bore 25 provides a shoulder 24 against which an upper annular surface 35 of a bushing 27 may bear, being fastened thereto by any suitable fastening means including an adhesive.

The molded floatation plug 56 is formed of a buoyancy enhancing material such as a closed cell expanded or foamed material. Plug 56 is provided with circumferentially spaced slots 60 at an upper end thereof configured to engage circumferentially spaced fins 68 connecting the cylinder 70 with the surface of bore 21. Plug 56 is provided with a bore 76 which enables plug 56 to be inserted into bore 21 until fins 68 fully engage slots 60. Spring 23 when fully compressed by guard 28 is fully contained within bore 76 as shown in FIG. 2.

The protective guard 28 is preferably a molding formed of synthetic resin material and is provided with the cylindrical enlarged head 29 formed at an upper end of a cylindrical shank or sheath portion 30 which is reciprocably received in the central circular opening 31 of bushing 27. An axial cylindrical passage 32 extends through guard 28, and guard 28 is thus reciprocably mounted on pick 17 and guided thereby.

The compression spring 23 encircles the pick 17 and its lower end abuts the upper end surface 33 of the guard head 29. The spring 23 and pick guard 28 are positioned on pick 17 within bore 21 before the bushing 27 is firmly secured within casing counterbore 25 as by means of a suitable adhesive or alternatively by means of a press fit.

When ice piercing pick device 48 is not in use, see FIG. 4 of my above identified prior art U.S. Pat. No. 4,002,366, spring 23 is still partly compressed and the annular underneath shoulder 34 of guard head 29 is held against the upper annular surface 35 of bushing 27, in which the lower end of pick 17 including pointed end portion 19 is covered by guard 28. Thus the ice piercing pick device 48 can be kept in a jacket pocket without clothing damage to the wearer by the pointed end 19 of the pick 17. Additionally, it is desirable not to make the point 19 on the pick 17 to sharp, such as to cause possible injury to the user. Thus, the point is blunted slightly but not such as to impair its ice piercing qualities.

When pick 17 is forcefully jabbed into the ice 42 as shown in FIG. 2, the nose portion 36 of guard 28, which may be chamfered or slightly rounded as shown in FIGS. 2, 4 and 5 of my above identified earlier U.S. Pat. No. 4,002,366, engages ice 42 and immediately guard 28 retracts upwardly in bore 21 against the tension of spring 23, the distance of travel of guard 28 being limited by shoulder 37 formed at the lower end of ribs 74. As may be clearly seen in FIG. 2, the maximum distance of travel of guard 28 relative to casing 12 as limited by shoulders 37 and surface 35 is less than 50% of the overall length of the outer casing 12. When pick 17 has been jabbed into the ice 42 to the maximum possible depth, then the underneath and lowermost surfaces of the casing 12, bushing 27 and guard 28 are substantially flush with each other (as shown in FIG. 2) and there is little likelihood of any snow (which may be on the surface of ice 42) packing and clogging the underside of ice piercing pick device 48 such as to cause the guard 28 to become jammed in the retracted position shown in FIG. 2. It is very important that the pick 17 not be subjected to lateral bending relative to the axis of its carrying casing 12 during the forceful jabbing of the pointed end 19 into the solid ice 42 and the subsequent radial pulling on the pick as a temporary anchor. Resistance to such bending is assured by providing a relatively close, but sliding fit of the cylindrical elongated shank portion of the pick 17 within the internal bore or passage 32 of the guard 28 together with the close, but sliding fit of the outer cylindrical wall of sheath portion 30 of the guard 28 within the bushing opening 31 together with the close but sliding fit of the guard head 29 with bore 21. It will be understood that during the jabbing stroke, appreciable lateral thrust is imposed on the pointed end 19 as well as the vertical thrust. After the pointed end 19 is jabbed into the ice 42, the extensive lateral force is imposed on the pick 17 as the person using the pick 17 pulls himself toward the pick 17 in an almost totally radial direction (which is largely predominant during the jabbing stroke).

The extent of resistance offered by spring 23 when substantially fully compressed is relatively light so that the retraction of guard 28 during ice jabbing is rather easily effected.

The length and circumference of ice piercing pick device 48 is preferably about as shown in FIGS. 1 and 2 and it can be seen that the outer surface of the casing 12 thus can be firmly gripped by the fingers and palm of a human hand. If desired, additional gripping action can be afforded by forming serrations in the exterior surface of the casing 12.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. An ice lifesaving device comprising:

at least one ice piercing device which includes:

a substantially vertically directed outer casing forming a hand gripping handle;

at least one elongated, vertically disposed recessed area on an outer surface of said hand gripping handle to facilitate hand gripping of said handle;

a pair of grooves on said outer surface of said handle disposed above said elongated, vertically disposed recessed area to facilitate gripping of said handle by a thumb and index finger under adverse conditions;

a pick having an upper end secured within a cylinder located at a top portion of said casing;

said casing having a first axially aligned inner bore therein encompassing said cylinder and having a first diameter, and a second counterbore axially aligned with and connected to said first inner bore, said second counterbore having a diameter greater than said first diameter, said first inner bore having an upper and lower end;

a molded floatation plug inserted into said first inner bore to increase buoyancy of said casing, said floatation plug having a third bore therein to receive said cylinder and means to engage fins formed between said first inner bore and said cylinder to retain said floatation plug within said first inner bore;

a pick guard positioned below the molded floatation plug for reciprocation within said first inner bore, said pick guard having a passage extending therethrough and being reciprocably mounted on the pick;

a frusto-conical member formed on the cylinder intermediate the upper and lower end of the first inner bore;

a spring encircling the pick and interposed between the frusto-conical member and the guard for normally urging the guard downwardly;

means within the casing for limiting the downward travel of the guard; and said pick having an ice piercing pointed nose at its lower end.

2. An ice lifesaving device as in claim 1, further comprising:

at least two duplicate ice piercing devices each having a casing, said casings connected by a floatable cord passing through a hole at the top of each casing.

3. An ice lifesaving device as in claim 2, wherein each said guard includes a sheath portion and a head portion diametrically larger relative to the sheath portion and located at the upper end of said sheath portion, the lower end of the spring engaging the guard head portion, and a first shoulder formed intermediate the upper and lower end of the first inner bore in each casing serving to limit upward travel of each respective guard.

4. An ice lifesaving device as in claim 3 wherein the means for limiting the downward travel of each said guard includes a respective bushing secured to and within each said second counterbore, each said bushing having an upper surface, and a central opening therethrough for closely receiving and guiding the respective sheath portion of each said guard during movement thereof.

5. An ice lifesaving device as in claim 4 wherein a second shoulder is formed in each said casing at the juncture of said first inner bore and said second counterbore to provide a seat for said upper surface of said bushing thereby limiting the upward travel of said bushing within said casing.

6. An ice lifesaving device as in claim 3, wherein the maximum distance of axial travel of each said guard relative to the respective outer casing is less than 50% of the overall length of the respective outer casing.

7. An ice lifesaving device as in claim 6, wherein each said spring abuts and engages an upper end wall of the respective guard head portion and the passage in each said guard is closely fitted relative to an outer wall diameter of the respective pick so as to reciprocably accommodate the respective pick in substantially the same close fit throughout the full length of the respective guard relative to the respective pick.

8. An ice lifesaving device as in claim 7 wherein the outer wall diameter of the respective pick relative to the inside diameter of the respective guard passage is substantially constant throughout the full length of travel of the respective guard relative to the respective pick.

* * * * *